US011254997B2

(12) United States Patent
Lee et al.

(10) Patent No.: US 11,254,997 B2
(45) Date of Patent: Feb. 22, 2022

(54) NON-ORIENTED ELECTRICAL STEEL SHEET AND MANUFACTURING METHOD THEREFOR

(71) Applicant: POSCO, Pohang-si (KR)

(72) Inventors: Hunju Lee, Pohang-si (KR); Dong Gwan Kim, Pohang-si (KR); So Hyun Park, Pohang-si (KR); Kyunghan Kim, Pohang-si (KR)

(73) Assignee: POSCO, Pohang-si (KR)

( * ) Notice: Subject to any disclaimer, the term of this patent is extended or adjusted under 35 U.S.C. 154(b) by 56 days.

(21) Appl. No.: 16/470,786

(22) PCT Filed: Dec. 19, 2017

(86) PCT No.: PCT/KR2017/015026
§ 371 (c)(1),
(2) Date: Jun. 18, 2019

(87) PCT Pub. No.: WO2018/117601
PCT Pub. Date: Jun. 28, 2018

(65) Prior Publication Data

US 2020/0087749 A1 Mar. 19, 2020

(30) Foreign Application Priority Data

Dec. 19, 2016 (KR) ..... 10-2016-0173922

(51) Int. Cl.

| | |
|---|---|
| ***C21D 9/46*** | (2006.01) |
| ***C22C 38/34*** | (2006.01) |
| ***C22C 38/24*** | (2006.01) |
| ***C22C 38/06*** | (2006.01) |
| ***C22C 38/04*** | (2006.01) |
| ***C22C 38/00*** | (2006.01) |
| ***C21D 8/12*** | (2006.01) |
| ***C21D 8/00*** | (2006.01) |
| ***C21D 6/00*** | (2006.01) |
| ***H01F 1/147*** | (2006.01) |

(52) U.S. Cl.
CPC ..... *C21D 9/46* (2013.01); *C21D 6/002* (2013.01); *C21D 6/005* (2013.01); *C21D 6/008* (2013.01); *C21D 8/005* (2013.01); *C21D 8/12* (2013.01); *C22C 38/001* (2013.01); *C22C 38/004* (2013.01); *C22C 38/04* (2013.01); *C22C 38/06* (2013.01); *C22C 38/24* (2013.01); *C22C 38/34* (2013.01); *H01F 1/14791* (2013.01); *C22C 2202/02* (2013.01)

(58) Field of Classification Search
None
See application file for complete search history.

(56) References Cited

U.S. PATENT DOCUMENTS

| | | | | |
|---|---|---|---|---|
| 6,428,632 | B1 | 8/2002 | Fujiyama et al. | |
| 2014/0345751 | A1 | 11/2014 | Oda et al. | |
| 2017/0274432 | A1 * | 9/2017 | Okubo | C22C 38/60 |

FOREIGN PATENT DOCUMENTS

| | | | | | |
|---|---|---|---|---|---|
| CN | 105296849 | A | | 2/2016 | |
| CN | 105378130 | A | | 3/2016 | |
| CN | 105908072 | A | | 8/2016 | |
| JP | H05-005126 | A | | 1/1993 | |
| JP | 07305114 | A | * | 11/1995 | H01F 1/14775 |
| JP | H07-305114 | A | | 11/1995 | |
| JP | 08041542 | A | * | 2/1996 | |
| JP | H08-041542 | A | | 2/1996 | |
| JP | 2007-186791 | A | | 7/2007 | |
| JP | 2008-240104 | A | | 10/2008 | |
| JP | 2010-121150 | A | | 6/2010 | |
| JP | 2011-006731 | A | | 1/2011 | |
| JP | 2011-132558 | A | | 7/2011 | |
| JP | 2011-184787 | A | | 9/2011 | |
| JP | 2012-112015 | A | | 6/2012 | |
| JP | 2016-003371 | A | | 1/2016 | |
| KR | 10-0479992 | B1 | | 3/2005 | |
| KR | 100479992 | B1 | * | 3/2005 | |
| KR | 10-2011-0015278 | A | | 2/2011 | |
| KR | 10-2012-0035212 | A | | 4/2012 | |
| KR | 10-1296130 | B1 | | 8/2013 | |
| KR | 10-1302895 | B1 | | 9/2013 | |
| KR | 10-2014-0044929 | A | | 4/2014 | |
| KR | 10-2015-0016434 | A | | 2/2015 | |
| KR | 10-2015-0062245 | A | | 6/2015 | |
| KR | 10-2016-0073222 | A | | 6/2016 | |
| KR | 20160073222 | A | * | 6/2016 | |
| WO | 2007/007423 | A1 | | 1/2007 | |

OTHER PUBLICATIONS

Extended European Search Report dated Nov. 7, 2019 issued in European Patent Application No. 17883674.8.
Japanese Office Action dated Aug. 4, 2020 issued in Japanese Patent Application No. 2019-554464.
International Search Report and Written Opinion dated May 15, 2018 issued in International Patent Application No. PCT/KR2017/015026 (with partial English translation).
Chinese Office Action dated Dec. 25, 2020 issued Chinese Patent Application No. 201780078694.2.
Office Action issued in corresponding European Patent Application No. 17883674.8, dated Jan. 18, 2021.

* cited by examiner

*Primary Examiner* — Jenny R Wu
(74) *Attorney, Agent, or Firm* — Morgan, Lewis & Bockius LLP

(57) ABSTRACT

An embodiment of the present invention provides a non-oriented electrical steel sheet, including Si at 2.0 to 4.0 wt %, Al at 1.5 wt % or less (excluding 0 wt %), Mn at 1.5 wt % or less (excluding 0 wt %), Cr at 0.01 to 0.5 wt %, V at 0.0080 to 0.015 wt %, C at 0.015 wt % or less (excluding 0 wt %), N at 0.015 wt % or less (excluding 0 wt %), and the remainder including Fe and other impurities unavoidably added thereto.

$$0.004 \leq ([C]+[N]) \leq 0.022 \quad \text{[Equation 1]}$$

(In Equation 1, [C] and [N] represent a content (wt %) of C and N, respectively.)

14 Claims, No Drawings

NON-ORIENTED ELECTRICAL STEEL SHEET AND MANUFACTURING METHOD THEREFOR

CROSS-REFERENCE OF RELATED APPLICATIONS

This application is the U.S. National Phase under 35 U.S.C. § 371 of International Patent Application No. PCT/KR2017/015026, filed on Dec. 19, 2017, which in turn claims the benefit of Korean Application No. 10-2016-0173922, filed on Dec. 19, 2016, the entire disclosures of which applications are incorporated by reference herein.

TECHNICAL FIELD

The present invention relates to a non-oriented electrical steel sheet and a manufacturing method thereof.

BACKGROUND ART

A non-oriented electrical steel sheet is mainly used in a motor that converts electrical energy to mechanical energy, and an excellent magnetic characteristic of the non-oriented electrical steel sheet is required to achieve high efficiency while the motor converts the electrical energy to the mechanical energy. Recently, as environmentally-friendly technology has been highlighted, it has become very important to increase efficiency of the motor using about half of the total electrical energy, and for this, demand for non-oriented electrical steel with an excellent magnetic characteristic is also increasing.

The magnetic characteristic of the non-oriented electrical steel sheet is typically evaluated through iron loss and magnetic flux density. The iron loss means energy loss occurring at a specific magnetic flux density and frequency, and the magnetic flux density means a degree of magnetization obtained in a specific magnetic field. As the core loss decreases, a more energy efficient motor may be manufactured in the same conditions, and as the magnetic flux density is higher, it is possible to downsize the motor and to reduce copper loss, thus it is important to manufacture the non-oriented electrical steel sheet having low iron loss and high magnetic flux density.

The iron loss and the magnetic flux density have different values depending on a measurement direction because they have anisotropy.

Generally, magnetic properties in a rolling direction are the best, and when the rolling direction is rotated by 55 to 90 degrees, the magnetic properties are significantly degraded. Since the non-oriented electrical steel sheet is used in a rotating machine, lower anisotropy is advantageous for stable operation thereof, and the anisotropy may be reduced by improving a texture of the steel. When {011} <uvw> orientation or {001} <uvw> orientation increases, the average magnetism property is excellent, but the anisotropy is very large; when {111} <uvw> orientation increases, the average magnetism is low, and the anisotropy is small; and when {113} <uvw> orientation increases, the average magnetism is relatively good, and the anisotropy is not so great.

A typically used method for increasing the magnetic properties of the non-oriented electrical steel sheet is to add an alloying element such as Si. The addition of the alloying element can increase specific resistance of the steel, and as the specific resistance is higher, eddy current loss decreases, thereby reducing the total iron loss. In order to increase the specific resistance of the steel, it is possible to produce an excellent non-oriented electrical steel sheet by adding an element such as Al and Mn together with Si.

In order to improve the magnetic properties of the non-oriented electrical steel sheet, reduction of steel-making impurities is particularly important. Impurities inevitably included in a steel-making process precipitate as carbides, nitrides, sulfides, and the like in a final product, which interferes with grain growth and magnetic wall movement, thereby deteriorating the magnetic properties of the non-oriented electrical steel sheet. Therefore, for the production of the non-oriented electrical steel sheet, it is essential to clean up the steel-making process to minimize the content of all impurities, which leads to a decrease in productivity and an increase in a process cost.

In order to solve the above problems, a method for manufacturing a non-oriented electrical steel sheet having excellent strength and excellent high frequency magnetic properties by appropriately controlling contents of Ti, C, N, and the like has been proposed. However, while the strength of the non-oriented electrical steel sheet according to the proposed method is superior to that of a conventional high-grade non-oriented electrical steel sheet, since an amount of carbonitride significantly increases due to excessive contents of C and N, the magnetism of the steel is actually deteriorated.

DISCLOSURE

The present invention has been made in an effort to provide a non-oriented electrical steel sheet and a manufacturing method thereof. Specifically, a non-oriented electrical steel sheet having excellent magnetic properties is provided at a low cost.

An embodiment of the present invention provides a non-oriented electrical steel sheet including: Si at 2.0 to 4.0 wt %, Al at 1.5 wt % or less (excluding 0 wt %), Mn at 1.5 wt % or less (excluding 0 wt %), Cr at 0.01 to 0.5 wt %, V at 0.0080 to 0.015 wt %, C at 0.015 wt % or less (excluding 0 wt %), N at 0.015 wt % or less (excluding 0 wt %), and the remainder including Fe and other impurities unavoidably added thereto, and satisfying Equation 1 below.

$$0.004 \leq ([C]+[N]) \leq 0.022 \quad \text{[Equation 1]}$$

(In Equation 1, [C] and [N] represent a content (wt %) of C and N, respectively.)

Equation 2 below may be satisfied.

$$\{0.5 \times ([C]+[N])+0.001\} \leq [V]$$

(In Equation 2, [C], [N], and [V] represent a content (wt %) of C, N, and V, respectively.)

At least one of S at 0.005 wt % or less (excluding 0 wt %), Ti at 0.005 wt % or less (excluding 0 wt %), Nb at 0.005 wt % or less (excluding 0 wt %), Cu at 0.025 wt % or less (excluding 0 wt %), B at 0.001 wt % or less (excluding 0 wt %), Mg at 0.005 wt % or less (excluding 0 wt %), and Zr at 0.005 wt % or less (excluding 0 wt %) may be further included.

Grains having a crystal orientation with respect to a cross-section in a thickness direction of a steel sheet that is within 15 degrees from {113} <uvw> may be included at 35% or more.

Grains having a crystal orientation with respect to a cross-section in a thickness direction of a steel sheet that is within 15 degrees from {111} <uvw> may be included at 20% or less.

Grains having a crystal orientation with respect to a cross-section in a thickness direction of a steel sheet that is within 15 degrees from {001} <uvw> may be included at 15% to 25%.

Equation 3 below may be satisfied.

([Average circular iron loss]−[Average LC iron loss])/([Average circular iron loss]+[Average LC iron loss])≤0.03 [Equation 3]

(In Equation 3, [Average circular iron loss] represents an average value of W15/50 measured at 0, 15, 30, 45, 60, 75, and 90 degrees in a rolling direction, and [Average LC iron loss] represents an average value of W15/50 measured at 0 and 90 degrees in a rolling direction.)

The average circular iron loss ($W_{15/50}$) may be 2.60 W/Kg or less, and the average LC iron loss ($W_{15/50}$) may be 2.50 W/kg or less.

A magnetic flux density ($B_{50}$) may be 1.68 T or more.

Another exemplary embodiment of the present invention provides a manufacturing method of a non-oriented electrical steel sheet, wherein the non-oriented electrical steel sheet includes Si at 2.0 to 4.0 wt %, Al at 1.5 wt % or less (excluding 0 wt %), Mn at 1.5 wt % or less (excluding 0 wt %), Cr at 0.01 to 0.5 wt %, V at 0.0080 to 0.015 wt %, C at 0.015 wt % or less (excluding 0 wt %), N at 0.015 wt % or less (excluding 0 wt %), and the remainder including Fe and other impurities unavoidably added thereto, including: heating a slab satisfying Equation 1 below; hot-rolling the slab to produce a hot-rolled sheet; cold-rolling the hot-rolled sheet to produce a cold-rolled sheet; and finally annealing the cold-rolled sheet.

0.004≤([C]+[N])≤0.022 [Equation 1]

(In Equation 1, [C] and [N] represent a content (wt %) of C and N, respectively.)

The slab may satisfy Equation 2 below.

{0.5×([C]+[N])+0.001}≤[V] [Equation 2]

(In Equation 2, [C], [N], and [V] represent a content (wt %) of C, N, and V, respectively.)

The slab may further include at least one of S at 0.005 wt % or less (excluding 0 wt %), Ti at 0.005 wt % or less (excluding 0 wt %), Nb at 0.005 wt % or less (excluding 0 wt %), Cu at 0.025 wt % or less (excluding 0 wt %), B at 0.001 wt % or less (excluding 0 wt %), Mg at 0.005 wt % or less (excluding 0 wt %), and Zr at 0.005 wt % or less (excluding 0 wt %).

The manufacturing method of the non-oriented electrical steel sheet may further include, after the preparing of the hot-rolled sheet, hot-annealing the hot-rolled sheet.

After the finally annealing, grains having a crystal orientation with respect to a cross-section in a thickness direction of a steel sheet that is within 15 degrees from {113} <uvw> may be included at 35% or more. After the finally annealing, Equation 3 below may be satisfied.

([Average circular iron loss]−[Average LC iron loss])/([Average circular iron loss]+[Average LC iron loss])≤0.03 [Equation 3]

(In Equation 3, [Average circular iron loss] represents an average value of W15/50 measured at 0, 15, 30, 45, 60, 75, and 90 degrees in a rolling direction, and [Average LC iron loss] represents an average value of W15/50 measured at 0 and 90 degrees in a rolling direction.)

According to the non-oriented electrical steel sheet and the manufacturing method thereof of the embodiment, it is possible to provide a non-oriented electrical steel sheet that is excellent in magnetic properties even with a sufficiently high content of V, C, and N at a low cost.

MODE FOR INVENTION

It will be understood that, although the terms first, second, third, etc. may be used herein to describe various elements, components, regions, layers, and/or sections, they are not limited thereto. These terms are only used to distinguish one element, component, region, layer, or section from another element, component, region, layer, or section. Thus, a first component, constituent element, or section described below may be referred to as a second component, constituent element, or section, without departing from the range of the present invention.

The terminologies used herein are used just to illustrate a specific exemplary embodiment, but are not intended to limit the present invention. An expression used in the singular encompasses the expression of the plural, unless it has a clearly different meaning in the context. It will be further understood that the term "comprises" or "includes", used in this specification, specifies stated properties, regions, integers, steps, operations, elements, and/or components, but does not preclude the presence or addition of other properties, regions, integers, steps, operations, elements, components, and/or groups.

When referring to a part as being "on" or "above" another part, it may be positioned directly on or above another part, or another part may be interposed therebetween. In contrast, when referring to a part being "directly above" another part, no other part is interposed therebetween.

Unless defined otherwise, all terms including technical and scientific terms used herein have the same meaning as commonly understood by one of ordinary skill in the art to which the present invention belongs. Terms defined in commonly used dictionaries are further interpreted as having meanings consistent with the relevant technical literature and the present disclosure, and are not to be construed as idealized or very formal meanings unless defined otherwise.

Unless otherwise stated, % means % by weight, and 1 ppm is 0.0001% by weight.

In an exemplary embodiment of the present invention, the meaning of further comprising/including an additional element implies replacing a remaining iron (Fe) by an additional amount of the additional element.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

According to an embodiment of the present invention, it is possible to optimize a composition of a non-oriented electrical steel sheet, particularly to optimize amounts of Si, Al, and Mn as main additive components, and it is possible to provide a non-oriented electrical steel sheet that is excellent in magnetic properties at a low cost by increasing a grain growth rate by adding an appropriate amount of Cr even when contents of V, C, and N are sufficiently high.

A non-oriented electrical steel sheet according to an embodiment of the present invention includes: Si at 2.0 to 4.0 wt %, Al at 1.5 wt % or less (excluding 0 wt %), Mn at 1.5 wt % or less (excluding 0 wt %), Cr at 0.01 to 0.5 wt %, V at 0.0080 to 0.015 wt %, C at 0.015 wt % or less (excluding 0 wt %), N at 0.015 wt % or less (excluding 0 wt %), and the remainder including Fe and other impurities unavoidably added thereto.

First, the reason for limiting the components of the non-oriented electrical steel sheet will be described.

Si at 2.0 to 4.0 wt %

Silicon (Si) serves to reduce iron loss by increasing specific resistance of a material, and when too little is added, an effect of improving high frequency iron loss may be insufficient. In contrast, when too much is added, hardness of the material increases and thus a cold-rolling property is extremely deteriorated, so that productivity and a punching property may deteriorate. Therefore, Si may be added in the above-mentioned range.

Al at 1.5 wt % or less

Aluminum (Al) serves to reduce iron loss by increasing specific resistance of a material, and when to much is added, nitrides may be excessively formed to deteriorate magnetism, thereby causing problems in all processes including steel-making and continuous casting processes, which may greatly reduce productivity. Therefore, Al may be added in the above-mentioned range. Specifically, Al may be contained in an amount of 0.1 to 1.3 wt %.

Mn at 1.5 wt % or less

Manganese (Mn) serves to increase specific resistance of a material to improve iron loss and form sulfides, and when too much is added, a magnetic flux density may be reduced by promoting formation of {111} texture that is disadvantageous to magnetism. Therefore, Mn may be added in the above-mentioned range. Specifically, Mn may be contained in an amount of 0.1 to 1.2 wt %.

Cr at 0.01 to 0.5 wt %

Chromium (Cr) has an effect of improving grain growth while increasing specific resistance of a material. Cr reduces activity of C and N to suppress carbonitride formation, and allows larger grains to be formed at the same annealing temperature by lowering recrystallization-starting temperature. Particularly, the addition of Cr causes {113} <uvw> texture to grow, and the {113} <uvw> texture reduces magnetic anisotropy compared to {001} <uvw> texture. When too little Cr is added, the above-mentioned effect is insignificant, and when too much Cr is added, Cr produces carbides, thereby degrading magnetism. Specifically, Cr may be contained in an amount of 0.02 to 0.35 wt %.

V at 0.0080 to 0.015 wt %

Vanadium (V) forms carbonitride in a material to suppress grain growth and interfere with movement of a magnetic domain, which mainly degrade magnetism. However, in the embodiment of the present invention, since the carbonitride produced by the combination of Cr and V is remarkably suppressed by the addition of Cr, an effect of magnetic deterioration is small, and the addition of V may reduce a fraction of {111} <uvw> texture that is disadvantageous to magnetism. When too little V is added, the above-mentioned effect is insignificant, and when too much V is added, V produces carbonitride, thereby degrading magnetism. Specifically, V may be contained in an amount of 0.008 to 0.012 wt %.

C at 0.015 wt % or less

Carbon (C) causes magnetic aging and combines with other impurity elements to generate carbides, thereby lowering the magnetic properties. Therefore, it is preferable that carbon (C) is contained in a small amount. In the embodiment of the present invention, an appropriate amount of Cr may be added, thus a large amount of C up to 0.015 wt % or less may be contained. Specifically, C may be contained in an amount of 0.0040 to 0.0140 wt %.

N at 0.015 wt % or less

Nitrogen (N) forms fine and long AlN precipitates inside a base material and forms fine mixtures by combining with other impurities to suppress grain growth and degrade iron loss. Therefore, it is preferable that nitrogen (N) is contained in a small amount. In the embodiment of the present invention, an appropriate amount of Cr may be added, thus a large amount of N up to 0.015 wt % or less may be contained. Specifically, N may be contained in an amount of 0.0040 wt % to 0.0145 wt %.

The above-described carbon and nitrogen is required to be managed not only individually but also in a sum amount thereof. In the exemplary embodiment of the present invention, the carbon and nitrogen may satisfy Equation 1 below.

$$0.004 \leq ([C]+[N]) \leq 0.022 \quad \text{[Equation 1]}$$

(In Equation 1, [C] and [N] represent a content (wt %) of C and N, respectively.)

The carbon and nitrogen form carbides and nitrides to deteriorate magnetism, so it is preferable that they are contained in as little an amount as possible. In the embodiment of the present invention, an appropriate amount of Cr may be added, thus large contents of C and N may be contained. However, when their content exceeds 0.022 wt %, they degrade magnetism, so that their contents are limited to 0.022 wt %.

The above-mentioned carbon and nitrogen need to be managed in conjunction with vanadium. In the exemplary embodiment of the present invention, the vanadium, carbon, and nitrogen may satisfy Equation 2 below.

$$\{0.5\times([C]+[N])+0.001\}[V] \quad \text{[Equation 1]}$$

(In Equation 2, [C], [N], and [V] represent a content (wt %) of C, N, and V, respectively.)

When Equation 2 is not satisfied, {111} <uvw> texture is insufficiently suppressed, the magnetism may deteriorate.

Impurity Elements

In addition to the above-mentioned elements, inevitably added impurities such as S, Ti, Nb, Cu, B, Mg, and Zr may be included. Although these elements are trace amounts, since they form inclusions in the steel to cause magnetic deterioration, Sat 0.005 wt % or less, Ti at 0.005 wt % or less, Nb at 0.005 wt % or less, Cu at 0.025 wt % or less, B at 0.001 wt % or less, Mg at 0.005 wt % or less, and Zr at 0.005 wt % or less should be managed.

As described above, the non-oriented electrical steel sheet according to the embodiment of the present invention may precisely control the component thereof to form a crystal structure that is excellent in magnetism and in which magnetic anisotropy is not large. Specifically, the grains having a crystal orientation with respect to a cross-section in a thickness direction of the steel sheet that is within 15 degrees from {113} <uvw> may be included at 35% or more. In the embodiment of the present invention, a content of the grains means an area fraction of the grains relative to the entire area when the cross-section of the steel sheet is measured by EBSD. The EBSD is a method of calculating an orientation fraction by measuring the cross-section of a steel sheet including the entire thickness layer by an area of 15 $mm^2$ or more. By containing a large amount of grains having a crystal orientation of {113} <uvw>, it is possible to obtain a non-oriented electrical steel sheet that is excellent in magnetism and not high in magnetic anisotropy.

In addition, the grains having a crystal orientation with respect to a cross-section in a thickness direction of the steel sheet that is within 15 degrees from {111} <uvw> may be included at 20% or less. Since the grains having the crystal orientation of {111} <uvw> are low in average magnetism, they may be less included in the embodiment of the present invention. In addition, the grains of which a crystal orientation with respect to a cross-section in a thickness direction of the steel sheet is within 15 degrees from {001} <uvw> may be included at 15 to 25%. Although the grains having the crystal orientation of {001} <uvw>, and have a high average magnetic property, it is preferable to maintain an appropriate fraction because the magnetic anisotropy thereof is also high.

As described above, by precisely controlling the component thereof, it is possible to obtain a non-oriented electrical steel sheet that is excellent in magnetic properties and also having small magnetic anisotropy. Specifically, it may satisfy Equation 3.

$$([\text{Average circular iron loss}]-[\text{Average LC iron loss}])/([\text{Average circular iron loss}]+[\text{Average LC iron loss}])\leq 0.03 \quad \text{[Equation 3]}$$

(In Equation 3, [Average circular iron loss] represents an average value of $W_{15/50}$ measured at 0, 15, 30, 45, 60, 75, and 90 degrees in a rolling direction, and [Average LC iron loss] represents an average value of $W_{15/50}$ measured at 0 and 90 degrees in a rolling direction.)

As such, the non-oriented electrical steel sheet according to the embodiment of the present invention does not have high magnetic anisotropy since a difference between the average value of the circular iron loss and the average value of the LC iron loss is not large.

More specifically, the average circular iron loss ($W_{15/50}$) may be 2.60 W/Kg or less, and the average LC iron loss ($W_{15/50}$) may be 2.50 W/kg or less. In addition, a magnetic flux density $B_{50}$ may be 1.68 T or more. As described above, the non-oriented electrical steel sheet according to the embodiment of the present invention has excellent magnetism.

A manufacturing method of the non-oriented electrical steel sheet according to the embodiment of the present invention, wherein the non-oriented electrical steel sheet includes Si at 2.0 to 4.0 wt %, Al at 1.5 wt % or less (excluding 0 wt %), Mn at 1.5 wt % or less (excluding 0 wt %), Cr at 0.01 to 0.5 wt %, V at 0.0080 to 0.015 wt %, C at 0.015 wt % or less (excluding 0 wt %), N at 0.015 wt % or less (excluding 0 wt %), and the remainder including Fe and other impurities unavoidably added thereto, includes: heating a slab satisfying Equation 1 below; hot-rolling the slab to produce a hot-rolled sheet; cold-rolling the hot-rolled sheet to produce a cold-rolled sheet; and finally annealing the cold-rolled sheet. Hereinafter, each step will be described in detail.

First, a slab is heated. The reason why the addition ratio of each composition in the slab is limited is the same as the reason for limiting the composition of the non-oriented electrical steel sheet described above, so repeated description is omitted. The composition of the slab is substantially the same as that of the non-oriented electrical steel sheet because the composition of the slab is not substantially changed during the manufacturing processes such as hot-rolling, annealing of a hot-rolled sheet, cold-rolling, and final annealing, which will be described later.

The slab is fed into a furnace and heated at 1100 to 1250° C. When heated at a temperature exceeding 1250° C., a precipitate may be redissolved, and it may be finely precipitated after the hot-rolling.

The heated slab is hot-rolled to 2 to 2.3 mm to produce a hot-rolled sheet. In the producing of the hot-rolled sheet, a finishing temperature may be 800 to 1000° C.

After the producing the hot-rolled sheet, a step of annealing the hot-rolled sheet may be further performed. In this case, an annealing temperature of the hot-rolled sheet may be 850 to 1150° C. When the annealing temperature of the hot-rolled sheet is less than 850° C., since the structure does not grow or finely grows, the synergy effect of the magnetic flux density is less, while when the annealing temperature exceeds 1150° C., since the magnetic characteristic deteriorates, rolling workability may be degraded due to deformation of a sheet shape. Specifically, the annealing temperature may be 950 to 1125° C. More specifically, the annealing temperature of the hot-rolled sheet is 900 to 1100° C. The hot-rolled sheet annealing is performed in order to increase the orientation favorable to magnetism as required, and it may be omitted.

Next, the hot-rolled sheet is pickled and cold-rolled to a predetermined thickness. Although differently applied depending on the thickness of the hot-rolled sheet, a reduction ratio of 70 to 95% may be applied thereto, and it may be cold-rolled to have a final thickness of 0.2 to 0.65 mm to prepare a cold-rolled steel sheet.

The final cold-rolled sheet is subjected to final annealing. The final annealing temperature may be 750 to 1150° C. When the final annealing temperature is too low, recrystallization may not sufficiently occur, and when the final annealing temperature is too high, rapid growth of the grains may occur, thus the magnetic flux density and high frequency iron loss may deteriorate. Specifically, the final annealing may be performed at a temperature of 900 to 1000° C. In the final annealing process, all (in other words, 99% or more) of the processed crystals formed in the previously cold-rolling step may be recrystallized. The grains of the final annealed steel sheet may have an average grain size of 50 to 95 μm.

Hereinafter, the present invention will be described in more detail through examples. However, the examples are only for illustrating the present invention, and the present invention is not limited thereto.

EXAMPLES

A slab that is formed as shown in Table 1 below and that contains the remainder of Fe and unavoidable impurities was prepared. The slab was heated at 1140° C. and hot-rolled at a finishing temperature of 880° C. to prepare a hot-rolled sheet having a thickness of 2.3 mm. The hot-rolled sheet was subjected to hot-rolled sheet annealing at 1030° C. for 100 seconds, pickled and cold-rolled to a thickness of 0.35 mm, and then final-annealed at 1000° C. for 110 seconds.

For each sample, the magnetic flux density ($B_{50}$), the average value of the circular iron loss ($W_{15/50}$), the average value of the the LC iron loss ($W_{15/50}$), the value of Equation 3, and the orientation fractions (%) of {001}, {113}, and {111} are shown in Table 2 below. The magnetic properties such as the magnetic flux density and the iron loss were measured with an Epstein tester after cutting samples of width 30 mm×length 305 mm×20 pieces for each sample. In this case, $B_{50}$ is a magnetic flux density induced at the magnetic field of 5000 A/m, and $W_{15/50}$ is an iron loss when the magnetic flux density of 1.5 T is induced at the frequency of 50 Hz. The circular iron loss average is the average of the iron loss values measured with the samples cut in the directions rotated 0, 15, 30, 45, 60, 75, and 90 degrees in the rolling direction, and the LC iron loss average is the average of the iron loss value measured with the samples cut in the directions rotated 0 and 90 degrees in the rolling direction.

The orientation fractions of {001}, {113}, and {111} were results that were measured 10 times by EBSD using the area of 350 μm×5000 μm and the 2 μm step interval without overlapping and then calculated as the orientation fractions {001} <uvw>, {113} <uvw>, and {111} <uvw> within the error range of 15 degrees by merging the measured data.

TABLE 1

| Sample number | Si (%) | Al (%) | Mn (%) | Cr (%) | V (%) | C (%) | N (%) | Satisfaction of Equation 1 | Satisfaction of Equation 2 |
|---|---|---|---|---|---|---|---|---|---|
| A1 | 2.2 | 0.3 | 0.15 | 0.007 | 0.0076 | 0.0061 | 0.0026 | ○ | ○ |
| A2 | 2.2 | 0.3 | 0.15 | 0.036 | 0.019 | 0.0036 | 0.0067 | ○ | ○ |
| A3 | 2.2 | 0.3 | 0.15 | 0.021 | 0.0086 | 0.0042 | 0.0088 | ○ | ○ |
| A4 | 2.2 | 0.3 | 0.15 | 0.47 | 0.0132 | 0.012 | 0.0091 | ○ | ○ |
| B1 | 2.7 | 1 | 0.3 | 0.271 | 0.0129 | 0.018 | 0.0014 | ○ | ○ |
| B2 | 2.7 | 1 | 0.3 | 0.61 | 0.0133 | 0.0139 | 0.0064 | ○ | ○ |
| B3 | 2.7 | 1 | 0.3 | 0.032 | 0.0098 | 0.0043 | 0.0091 | ○ | ○ |
| B4 | 2.7 | 1 | 0.3 | 0.345 | 0.0137 | 0.0062 | 0.0141 | ○ | ○ |
| C1 | 3 | 1.3 | 0.2 | 0.388 | 0.023 | 0.0051 | 0.0102 | ○ | ○ |
| C2 | 3 | 1.3 | 0.2 | 0.218 | 0.0127 | 0.0028 | 0.017 | ○ | ○ |
| C3 | 3 | 1.3 | 0.2 | 0.252 | 0.0119 | 0.0078 | 0.0091 | ○ | ○ |
| C4 | 3 | 1.3 | 0.2 | 0.031 | 0.0095 | 0.0051 | 0.0072 | ○ | ○ |
| D1 | 3.5 | 0.2 | 1.2 | 0.109 | 0.0144 | 0.012 | 0.013 | X | ○ |
| D2 | 3.5 | 0.2 | 1.2 | 0.82 | 0.0092 | 0.0082 | 0.0042 | ○ | ○ |
| D3 | 3.5 | 0.2 | 1.2 | 0.177 | 0.0109 | 0.0046 | 0.012 | ○ | ○ |
| D4 | 3.5 | 0.2 | 1.2 | 0.082 | 0.0103 | 0.0077 | 0.0054 | ○ | ○ |

TABLE 2

| Sample number | $B_{50}$ (T) | Circular iron loss average ($W_{15/50}$, W/kg) | LC iron loss average ($W_{15/50}$, W/kg) | Value of Equation 3 | {001} orientation fraction (%) | {113} orientation fraction (%) | {111} orientation fraction (%) | Remarks |
|---|---|---|---|---|---|---|---|---|
| A1 | 1.7 | 3.05 | 2.83 | 0.037 | 14 | 28 | 25 | Comparative Example |
| A2 | 1.7 | 3.03 | 2.79 | 0.041 | 13 | 27 | 27 | Comparative Example |
| A3 | 1.73 | 2.54 | 2.46 | 0.016 | 15 | 45 | 19 | Inventive Example |
| A4 | 1.73 | 2.51 | 2.44 | 0.014 | 16 | 43 | 20 | Inventive Example |
| B1 | 1.68 | 2.54 | 2.35 | 0.039 | 18 | 31 | 23 | Comparative Example |
| B2 | 1.68 | 2.53 | 2.36 | 0.035 | 16 | 28 | 25 | Comparative Example |
| B3 | 1.7 | 2.08 | 2.01 | 0.017 | 21 | 51 | 16 | Inventive Example |
| B4 | 1.7 | 2.08 | 2.02 | 0.015 | 20 | 49 | 16 | Inventive Example |
| C1 | 1.66 | 2.44 | 2.28 | 0.034 | 15 | 27 | 23 | Comparative Example |
| C2 | 1.66 | 2.47 | 2.3 | 0.036 | 15 | 29 | 26 | Comparative Example |
| C3 | 1.69 | 2.01 | 1.93 | 0.02 | 18 | 52 | 17 | Inventive Example |
| C4 | 1.69 | 1.98 | 1.91 | 0.018 | 20 | 48 | 16 | Inventive Example |
| D1 | 1.65 | 2.41 | 2.21 | 0.043 | 17 | 27 | 18 | Comparative Example |
| D2 | 1.65 | 2.44 | 2.25 | 0.041 | 16 | 25 | 20 | Comparative Example |
| D3 | 1.68 | 1.94 | 1.88 | 0.016 | 21 | 41 | 14 | Inventive Example |
| D4 | 1.68 | 1.96 | 1.89 | 0.018 | 22 | 38 | 13 | Inventive Example |

As shown in Table 1 and Table 2, A3, A4, B3, B4, C3, C4, D3, and D4 corresponding to the range of the present invention had excellent magnetic properties, the values of Equation 3 were 0.03 or less, and the orientation fractions satisfied 35% or more. In contrast, all of A1, A2, B1, B2, C1, C2, D1 and D2 having the contents of Cr, V, C, and, N out of the range of the present invention had poor magnetic properties, the values of Equation 3 exceeded 0.03, the orientation fractions were 35% or less, and the anisotropies were high.

The present invention may be embodied in many different forms, and should not be construed as being limited to disclosed embodiments. In addition, it will be understood by those skilled in the art that various changes in form and details may be made thereto without departing from the technical spirit and essential features of the present invention. Therefore, it is to be understood that the above-described exemplary embodiments are for illustrative purposes only, and the scope of the present invention is not limited thereto.

The invention claimed is:

1. A non-oriented electrical steel sheet, comprising:

Si at 2.0 to 4.0 wt %, Al at 1.5 wt % or less excluding 0 wt %, Mn at 1.5 wt % or less excluding 0 wt %, Cr at 0.01 to 0.5 wt %, V at 0.0080 to 0.015 wt %, C at 0.015 wt % or less excluding 0 wt %, N at 0.015 wt % or less excluding 0 wt %, and the remainder including Fe and other impurities unavoidably added thereto, and satisfying Equation 1 below:

$$0.004 \leq ([C]+[N]) \leq 0.022 \quad \text{[Equation 1]}$$

in Equation 1, [C] and [N] represent a content wt % of C and N, respectively, wherein grains having a crystal orientation with respect to a cross-section in a thickness direction of a steel sheet that is within 15 degrees from {113} <uvw> are included at 35% or more.

2. The non-oriented electrical steel sheet of claim 1, wherein

Equation 2 below is satisfied:

$$\{0.5\times([C]+[N])+0.001\} \leq [V] \quad \text{[Equation 2]}$$

in Equation 2, [C], [N], and [V] represent a content wt % of C, N, and V, respectively.

3. The non-oriented electrical steel sheet of claim 1, wherein at least one of S at 0.005 wt % or less excluding 0 wt %, Ti at 0.005 wt % or less excluding 0 wt %, Nb at 0.005 wt % or less excluding 0 wt %, Cu at 0.025 wt % or less excluding 0 wt %, B at 0.001 wt % or less excluding 0 wt %, Mg at 0.005 wt % or less excluding 0 wt %, and Zr at 0.005 wt % or less excluding 0 wt %, is further included.

4. The non-oriented electrical steel sheet of claim 1, wherein grains having a crystal orientation with respect to a cross-section in a thickness direction of a steel sheet that is within 15 degrees from {111} <uvw> are included at 20% or less.

5. The non-oriented electrical steel sheet of claim 4, wherein grains having a crystal orientation with respect to a cross-section in a thickness direction of a steel sheet that is within 15 degrees from {001} <uvw> are included at 15% to 25%.

6. The non-oriented electrical steel sheet of claim 1, wherein

Equation 3 below is satisfied:

$$([\text{Average circular iron loss}]-[\text{Average LC iron loss}])/([\text{Average circular iron loss}]+[\text{Average LC iron loss}]) \leq 0.03 \quad \text{[Equation 3]}$$

in Equation 3, [Average circular iron loss] represents an average value of W15/50 measured at 0, 15, 30, 45, 60, 75, and 90 degrees in a rolling direction, and [Average LC iron loss] represents an average value of W15/50 measured at 0 and 90 degrees in a rolling direction.

7. The non-oriented electrical steel sheet of claim 6, wherein the average circular iron loss (W15/50) is 2.60 W/Kg or less, and the average LC iron loss (W15/50) is 2.50 W/kg or less.

8. The non-oriented electrical steel sheet of claim 7, wherein a magnetic flux density (B50) is 1.68 T or more.

9. A manufacturing method of a non-oriented electrical steel sheet, wherein the non-oriented electrical steel sheet includes Si at 2.0 to 4.0 wt %, Al at 1.5 wt % or less excluding 0 wt %, Mn at 1.5 wt % or less excluding 0 wt %, Cr at 0.01 to 0.5 wt %, V at 0.0080 to 0.015 wt % C at 0.015 wt % or less excluding 0 wt %, N at 0.015 wt % or less excluding 0 wt %, and the remainder including Fe and other impurities unavoidably added thereto, comprising:

heating a slab satisfying Equation 1 below;

hot-rolling the slab to produce a hot-rolled sheet;

cold-rolling the hot-rolled sheet to produce a cold-rolled sheet; and finally annealing the cold-roiled sheet:

$$0.004 <= ([C]+[N]) <= 0.022 \quad \text{[Equation 1]}$$

in Equation 1, [C] and [N] represent a content wt % of C and N, respectively, thereby producing the non-oriented electrical steel sheet of claim 1.

10. The manufacturing method of the non-oriented electrical steel sheet of claim 9, wherein the slab satisfies Equation 2 below:

$$\{0.5\times([C]+[N])+0.001\} <= [V] \quad \text{[Equation 2]}$$

in Equation 2, [C], [N], and [V] represent a content wt % of C, N, and V, respectively.

11. The manufacturing method of the non-oriented electrical steel sheet of claim 9, wherein the slab further includes at least one of S at 0.005 wt % or less excluding wt %, Ti at 0.005 wt % or less excluding 0 wt %, Nb at 0.005 wt % or less excluding 0 wt %, Cu at 0.025 wt % or less excluding 0 wt %, B at 0.001 wt % or less excluding 0 wt %, Mg at 0.005 wt % or less excluding 0 wt %, and Zr at 0.005 wt % or less excluding 0 wt %.

12. The manufacturing method of the non-oriented electrical steel sheet of claim 9, further comprising after the preparing of the hot-rolled sheet, hot-annealing the hot-rolled sheet.

13. The manufacturing method of the non-oriented electrical steel sheet of claim 9, wherein after the finally annealing, grains having a crystal orientation with respect to a cross-section in a thickness direction of a steel sheet that is within 15 degrees from {113} <uvw> are included at 35% or more.

14. The manufacturing method of the non-oriented electrical steel sheet of claim 9, wherein after the finally annealing, Equation 3 below is satisfied:

$$([\text{Average circular iron loss}]-[\text{Average LC iron loss}])/([\text{Average circular iron loss}]+[\text{Average LC iron loss}]) <= 0.03 \quad \text{[Equation 3]}$$

in Equation 3, [Average circular iron loss] represents an average value of W15/50 measured at 0, 15, 30, 45, 60, 75, and 90 degrees in a rolling direction, and [Average LC iron loss] represents an average value of W15/50 measured at 0 and 90 degrees in a rolling direction.

* * * * *